US008047685B2

(12) United States Patent
Wu et al.

(10) Patent No.: US 8,047,685 B2
(45) Date of Patent: Nov. 1, 2011

(54) ADJUSTABLE LIGHTING DEVICE

(75) Inventors: Ching-Huei Wu, San Chung (TW); Chih-Hsien Wu, San Chung (TW); Sen-Yuh Tsai, San Chung (TW)

(73) Assignee: Unity Opto Technology Co., Ltd., San Chung (TW)

( * ) Notice: Subject to any disclaimer, the term of this patent is extended or adjusted under 35 U.S.C. 154(b) by 217 days.

(21) Appl. No.: 12/407,743

(22) Filed: Mar. 19, 2009

(65) Prior Publication Data

US 2009/0237940 A1 Sep. 24, 2009

(30) Foreign Application Priority Data

Mar. 19, 2008 (TW) ..... 97204679 U

(51) Int. Cl.
*F21V 29/00* (2006.01)

(52) U.S. Cl. ..... 362/277; 362/249.02; 362/235; 362/640; 362/646; 362/311.01

(58) Field of Classification Search ..... 362/249.02, 362/235, 244, 277, 278, 307, 308, 640, 646, 362/647, 650, 311.01, 311.02, 326
See application file for complete search history.

(56) References Cited

U.S. PATENT DOCUMENTS

| | | | | |
|---|---|---|---|---|
| 4,398,232 | A * | 8/1983 | Elmore | 361/47 |
| 4,398,238 | A * | 8/1983 | Nelson | 362/187 |
| 4,429,351 | A * | 1/1984 | Petzl et al. | 362/187 |
| 4,449,072 | A * | 5/1984 | Osada | 315/58 |
| 6,234,649 | B1 * | 5/2001 | Katougi | 362/248 |

* cited by examiner

*Primary Examiner* — Anabel Ton
(74) *Attorney, Agent, or Firm* — Apex Juris, pllc; Tracy M. Heims

(57) ABSTRACT

An adjustable lighting device having a main body, a light generation device inserted into a receptacle, a movable lens, a base electrically connected to the light generation device, and an adjustor cover rotatably mounted to and covering the outside of the main body so that rotation of the adjustor cover causes the lens to extend/retract within the receptacle so that the extension/retraction of the lens can be controlled by the rotation of the adjustor cover for realizing focus adjustment.

8 Claims, 4 Drawing Sheets

ADJUSTABLE LIGHTING DEVICE

PRIOR APPLICATIONS

This application is a substitute application that replaces the application previously filed on May 8, 2008, Ser. No. 12/149,843. The previous application went abandoned for failure to timely pay the filing fee. The content of this application is exactly the same as the previously filed application accept for the fact that the abstract has been amended to comply with filing requirements.

FIELD OF THE INVENTION

The present invention relates to an adjustable lighting device, and in particular to a lighting device comprising a combination of a main body, a light generation device, a lens, a base, and an adjustor cover for providing the advantages of focus adjustability and easy and secured assembling and applicable to various lighting device and the likes.

BACKGROUND OF THE INVENTION

Lighting can be classified as regular lighting and spot lighting. The former is for a wide lighting of a large area, while the latter is for concentrated lighting in a small, spot-like area.

For example, the wide lighting for a large area includes street lamps, post lamps in for example a park, or ceiling mounted pendant lighting. The purpose of the wide lighting is to illuminate the whole area with the least number of lighting devices.

Contrary to the regular lighting, the spot lighting is to condense light beam onto a specific spot or article to distinguish the spot or the article. For example, firstly, an exhibition lamp that is provided for the purposes of exhibition must condense the light spot on an exhibited article to distinguishably show the article. Secondly, spot lighting can be used for interior decoration for the modern interior decoration, except the aspect of hardware decoration, include an aspect of visual impression that is presented by lighting inside the house, of which the most commonly known measure is to condense and project light on for example a wall, an ornamentation or a dinning table so as to provide excellent visual and lighting effect with the combination of hardware decoration and the lighting.

However, some of the conventional lighting devices are not provided with the function of light condensation and/or focusing and most of the conventional lighting devices are not of the feature of focus adjustability. The former drawback make the use of the lighting device inconvenience or even impractical, while the latter drawback causes a situation of out of focusing of the projecting light on an irradiated article for the distance between the light source and the irradiated article can be various and cannot be accommodated by the lighting if no focus adjustability can be available.

Thus, the present invention is aimed to overcome the above discussed drawbacks.

SUMMARY OF THE INVENTION

An objective of the present invention is to provide an adjustable lighting device comprising a main body forming, in a front end thereof, a first receptacle in which a light generation device and a lens are received and an adjustor cover mounted to and covers the front end of the main body and having an inner circumference forming a threading engagement with an outer circumference of the lens to effect adjustment of focus by the extension/retraction of the lens driven by the rotation of the adjustor cover and also to provide easy and secured assembling, whereby the present invention enhances practicability.

Another objective of the present invention is to provide an adjustable lighting device comprising a base that is constructed as a conventional light bulb base and thus, the convenience of directly mounting to a regular bulb socket for operation can be realized, whereby the present invention enhances convenience.

A further objective of the present invention is to provide an adjustable lighting device, wherein a plurality of heat dissipation fins circumferentially surround the main body and a plurality of heat dissipation channels are respectively formed in an adjustor cover and an enclosure that surround the main body so that enhanced heat dissipation can be realized, whereby the present invention enhances heat dissipation performance.

To realize the above objectives, in accordance with the present invention, an adjustable lighting device is provided, comprising a main body, a light generation device, a lens, a base, and an adjustor cover. The main body has a first end forming a first receptacle. The light generation device comprises a light-emitting diode based light emission element and is fixed in the first receptacle. The lens is movably received in the first receptacle and has an outer circumference forming an external thread. The base is mounted to an opposite, second end of the main body and is in electrical connection with the light emission element. The adjustor cover forms an opening having an internal thread. The adjustor cover is rotatably mounted to and covers outside of the main body with the internal thread in engagement with the external thread of the lens. Thus, rotation of the adjustor cover causes the lens to extend/retract within the first receptacle. As such, advantages including light condensability, focus adjustability, easy and secured assembling, and direct applicability to a regular bulb socket are realized for ensuring practicability and convenience.

BRIEF DESCRIPTION OF THE DRAWINGS

The present invention will be apparent to those skilled in the art by reading the following description of a preferred embodiment thereof with reference to the drawings, in which.

DETAILED DESCRIPTION OF THE PREFERRED EMBODIMENT

Figure 1:
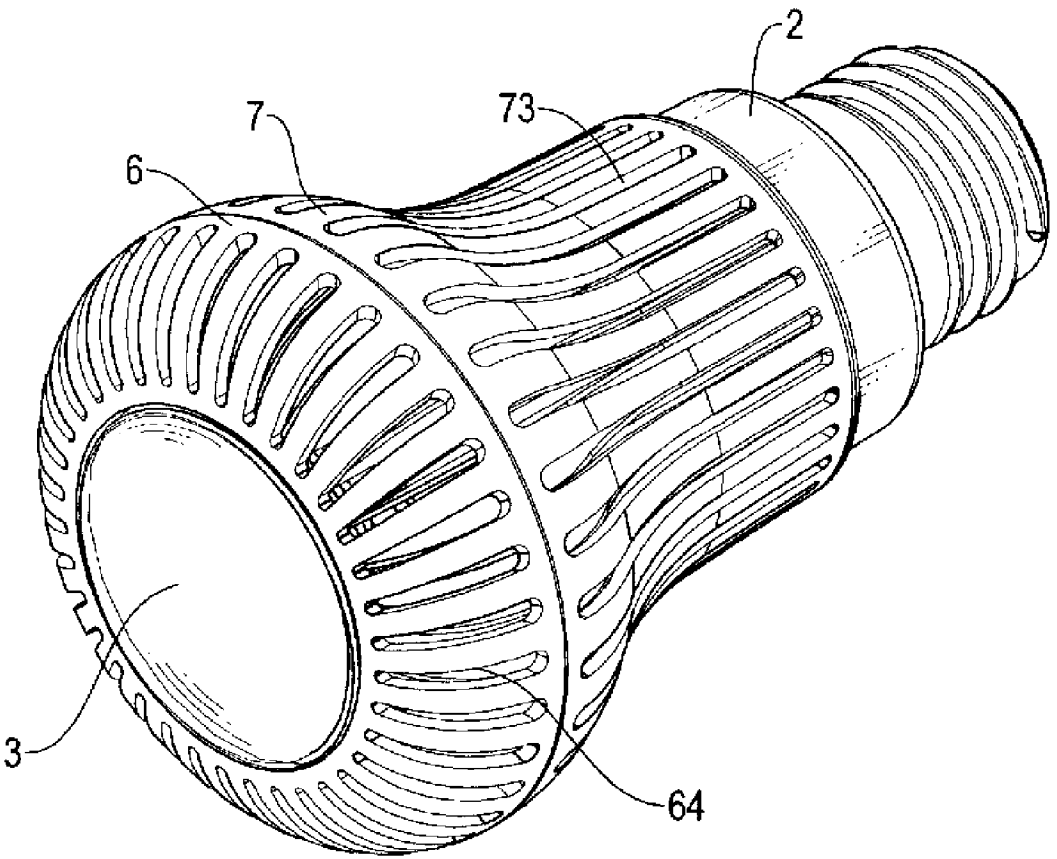
FIG. 1 is a perspective view of an adjustable lighting device constructed in accordance with the present invention.
Figure 2:
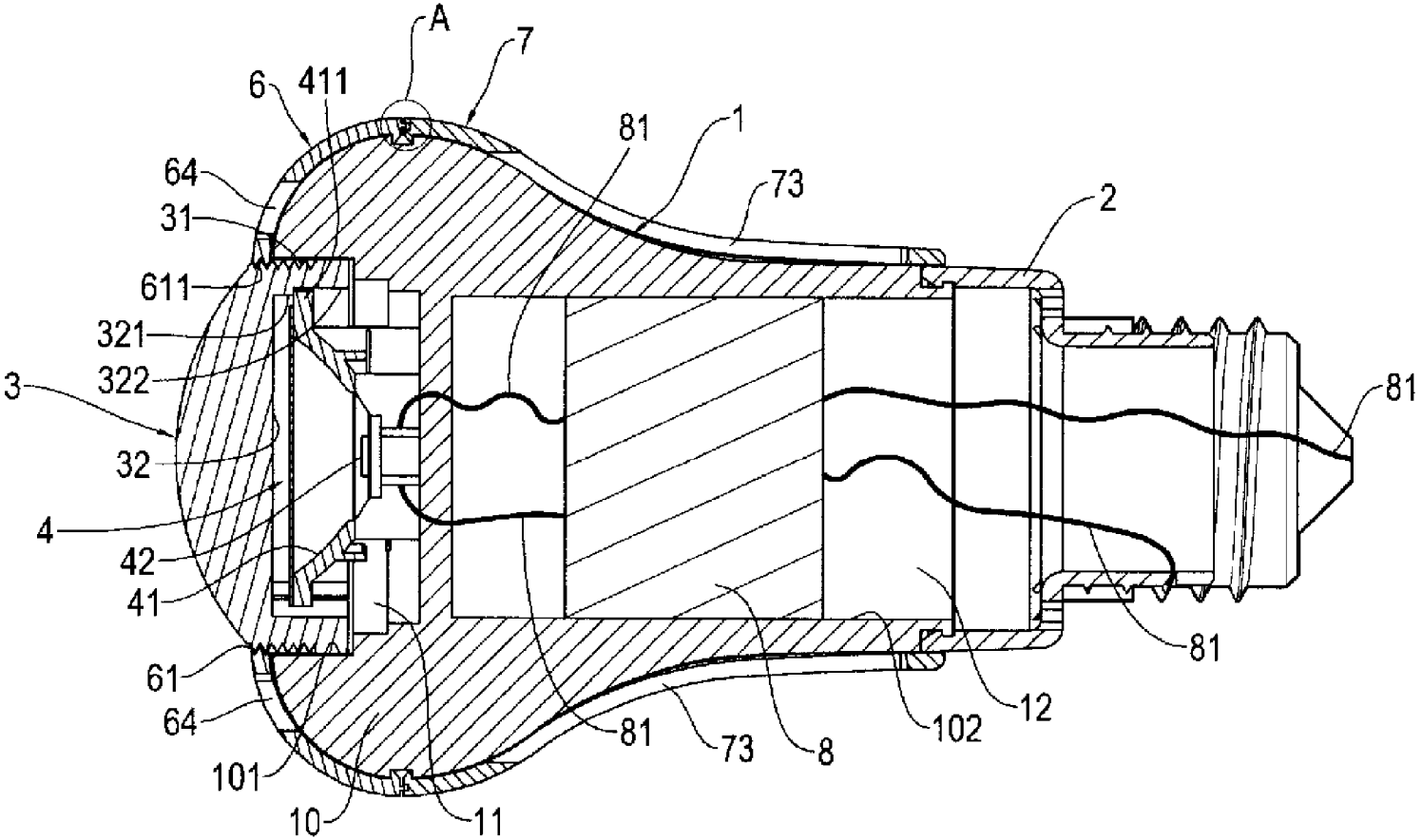
FIG. 2 is a cross-sectional view of the adjustable lighting device in accordance with a first embodiment of the present invention.
Figure 3:
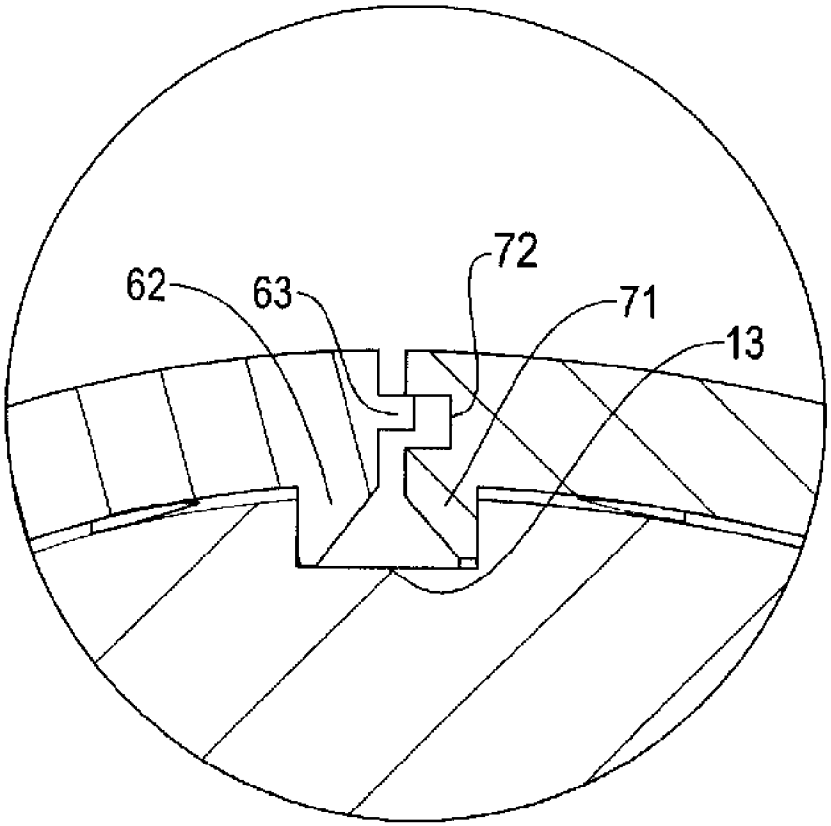
FIG. 3 is an enlarged view of encircled portion A of FIG. 2.
Figure 4:
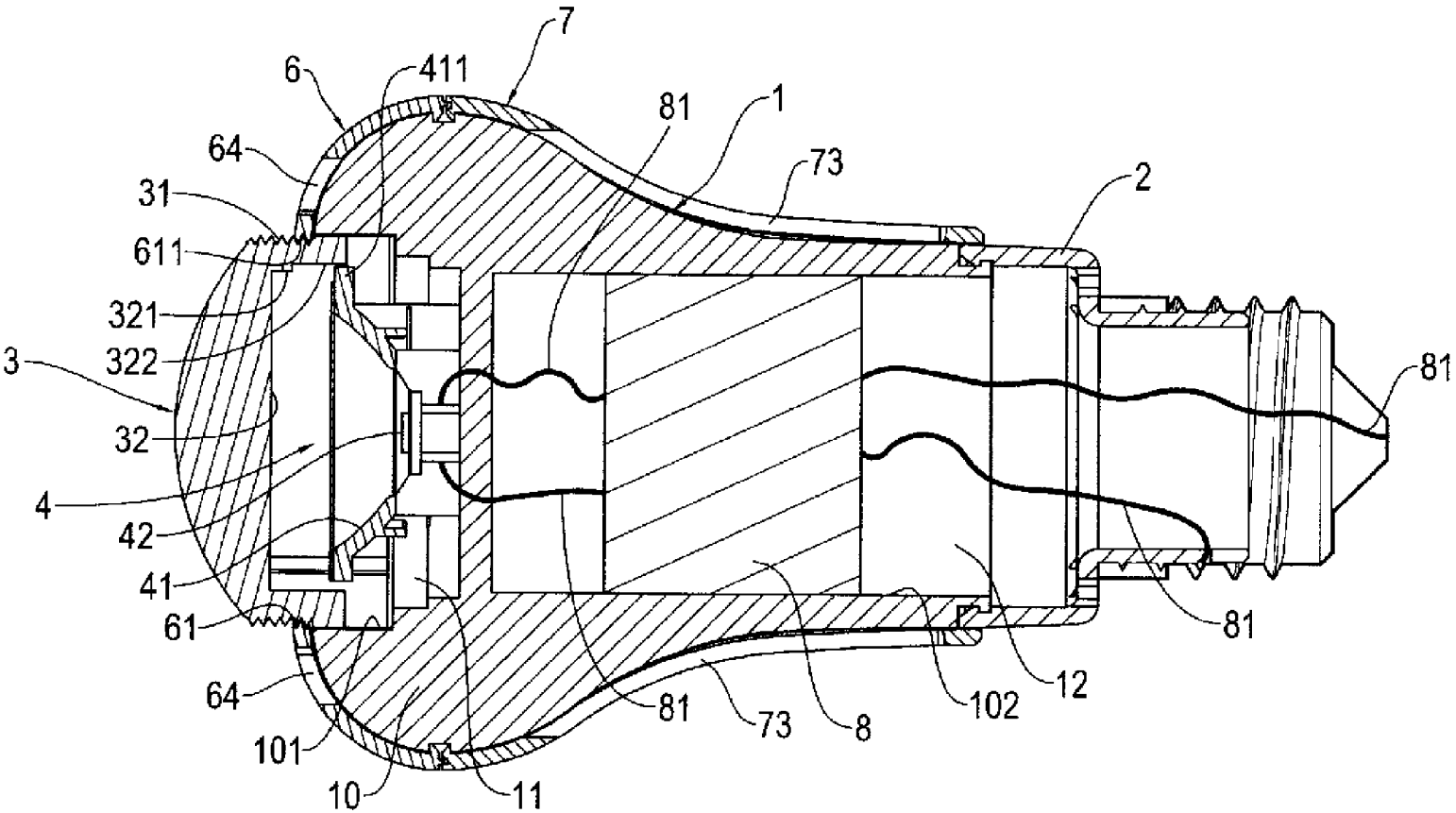
FIG. 4 is a cross-sectional view illustrating a situation after the adjustment of the adjustable lighting device of the present invention.

With reference to the drawings and in particular to FIGS. 1-4, An adjustable lighting device constructed in accordance with the present invention comprises a main body 1, a light generation device 4, a lens 3, a base 2, and an adjustor cover 6.

The main body 1 has a first end forming a first receptacle 11. The light generation device 4 comprises a light emission element 42. The light generation device 4 is fixed in the first receptacle 11. The lens 3 is movably received in the first receptacle 11. The lens 3 has an outer circumference forming an external thread 31. The base 2 is mounted to an opposite, second end of the main body 1 and the light generation device 42 is electrically connected to the base 2. The adjustor cover 6 forms an opening 61 forming an internal thread 611. The adjustor cover 6 is movably mounted to and encloses an outside surface of the first end portion of the main body 1. The internal thread 611 of the adjustor cover 6 is in threading engagement with the external thread 31 of the lens 3 whereby rotation of the adjustor cover 6 brings on extension/retraction of the lens 3 within the first receptacle 11 to effect focus adjustment.

The light generation device 4 comprises a condensation cap 41, which is fixed inside the first receptacle 11. The light emission element 42 is fixed in the condensation cap 41 (and is located at a center of the condensation cap 41 in the embodiment illustrated). The lens 3 forms a cavity 32 in which the condensation cap 41 is received. The cavity 32 has an inside surface 321 forming at least one guide slot 322 to which the condensation cap 41 forms at least one corresponding projection 411, whereby the at least one guide slot 322 of the lens 3 is fit over and slidable along the at least one projection 411 of the condensation cap 41 to effect guidance of the sliding movement thereof. The present invention further comprises an enclosure 7 that encloses outside the main body 1 and extends between the adjustor cover 6 and the base 2 with adjacent portions of the enclosure 7 and the base 2 partially overlapping each other. In the embodiment illustrated, the adjacent portion of the enclosure 7 is positioned on and overlaps the adjacent portion of the base 2. The enclosure 7 covers the main body 1 except those portions associated with the adjustor cover 6, the lens 3, and the base 2. The adjustor cover 6 and the enclosure 7 are both provided with a plurality of heat dissipation channels 64, 73 (as shown in FIG. 1). The main body 1 forms a circumferentially extending retention groove 13. The end of the adjustor cover 6 that is opposite to the opening 61 and the end of the enclosure 7 that is adjacent to the end of the adjustor cover 6 that is opposite to the opening 61 are both formed with a pawl 62, 71, which is received in and engages the retention groove 13. The end of the adjustor cover 6 that is opposite to the opening 61 and the end of the enclosure 7 that is adjacent to the end of the adjustor cover 6 that is opposite to the opening 61 are respectively provided with a positioning protrusion 63 and a positioning slot 72, wherein the positioning protrusion 63 is fit into the positioning slot 72 for positioning purposes. The light emission element 42 can be for example a regular light bulb or a light-emitting diode as illustrated in the present embodiment. The lighting device of the present invention further comprises a power conversion device 8. The second end of the main body 1 forms a second receptacle 12 in which the power conversion device 8 is received. The power conversion device 8 is electrically connected between the light emission element 42 and the base 2 by means of connection lines 81 whereby the power conversion device 8 converts an external power into electrical power applicable to the light-emitting diode. The main body 1 comprises a plurality of heat dissipation fins 10, each having a first end and an opposite second end respectively forming a first cutoff 101 and a second cutoff 102. The heat dissipation fins 10 are arranged in a circumferentially surrounding manner with the first cutoffs 101 together forming the first receptacle 11 of the main body 1 and the second cutoffs 102 forming the second receptacle 12 of the main body 1. The base 2 can be a base of a conventional light bulb.

The feature of the adjustable lighting device in accordance with the present invention is that the main body 1 of the lighting device of the present invention forms, in a first, front end thereof, a first receptacle 11 in which a light generation device 4 and a lens 3 are received and an adjustor cover 6 is mounted to and covers the front end of the main body 1 and has an inner circumference forming a threading engagement with an outer circumference of the lens 3 to effect adjustment of focus by the extension/retraction of the lens 3 driven by the rotation of the adjustor cover 6 and also to provide easy and secured assembling. With the base 2 being constructed as a conventional light bulb base, the convenience of directly mounting to a regular bulb socket (not shown) for operation can be realized. With a plurality of heat dissipation fins 10 circumferentially surrounding the main body 1 and also with a plurality of heat dissipation channels 64, 73 respectively formed in the adjustor cover 6 and the enclosure 7 that surround the main body 1, enhanced heat dissipation can be realized. Further, with the plurality of heat dissipation channels 64 defined in the adjustor cover 6, hand holding and rotation of the adjustor cover 6 can be ensured. With the guide slot 322 defined in the inside surface 321 of the lens 3 and the corresponding projection 411 formed on the condensation cap 41, the guide slot 322 of the lens 3 is fit over and slidable along the projection 411 to ensure guidance of the sliding movement thereof for extension/retraction of the lens 3 so that the extension/retraction of the lens 3 can be done in a more stable manner. To conclude, the present invention provides advantages including light condensability, focus adjustability, easy and secured assembling, direct applicability to a regular bulb socket, and enhanced heat dissipation and thus ensures practicability, convenience, and better heat dissipation.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An adjustable lighting device comprising:

a main body having a first end forming a first receptacle;

a light generation device comprising a condensation cap fixed in the first receptacle and a light-emitting diode based light emission element, the light emission element being received in the condensation cap;

a lens movably received in the first receptacle and having an outer circumference forming an external thread;

a base mounted to an opposite, second end of the main body and in electrical connection with the light emission element; and an adjustor cover forming an opening that forms an internal thread, the adjustor cover being rotatably covering outside of the main body with the internal thread in engagement with the external thread of the lens, whereby rotation of the adjustor cover causes the lens to extend/retract within the first receptacle.

2. The adjustable lighting device as claimed in claim 1, wherein the lens defines a cavity in which the condensation cap is received, the cavity having an inside surface in which at least one guide slot is defined, and wherein the condensation cap forms at least one projection, the guide slot being fit over and slidable along projection.

3. The adjustable lighting device as claimed in claim 1 further comprising an enclosure covering outside the main body and extending between the adjustor cover and the base, adjacent portions of the enclosure and the base being arranged to partially overlap each other.

4. The adjustable lighting device as claimed in claim 3, wherein the adjustor cover and the enclosure form a plurality of heat dissipation channels.

5. The adjustable lighting device as claimed in claim 3, wherein the main body forms a circumferentially extending retention groove and wherein the adjustor cover has an end opposite to the opening thereof and forming a pawl, and the enclosure has an end adjacent to said end of the adjustor cover and forming a pawl, the pawls of the adjustor cover and the enclosure being received in and engaging with the retention groove.

6. The adjustable lighting device as claimed in claim 5, wherein said end of the adjustor cover that is opposite to the opening of the adjustor cover and said end of the enclosure that is adjacent to the said end of the adjustor cover respectively form a positioning protrusion and a positioning slot, the positioning protrusion being fit into the positioning slot for positioning purposes.

7. The adjustable lighting device as claimed in claim 1 further comprising a power conversion device and wherein the second end of the main body forms a second receptacle in which the power conversion device is receive and fixed, the power conversion device electrically connecting between the light emission element and the base.

8. The adjustable lighting device as claimed in claim 1, wherein the main body comprises a plurality of heat dissipation fins, each having first and second ends respectively forming first and second cutoffs, the heat dissipation fins being arranged in a circumferentially surrounding manner with the first cutoffs together defining the first receptacle of the main body and the second cutoffs defining a second receptacle of the main body.

* * * * *